US010039402B1

(12) United States Patent
Strange

(10) Patent No.: US 10,039,402 B1
(45) Date of Patent: Aug. 7, 2018

(54) ARTIFICIAL TREE DISPLAY DEVICE

(71) Applicant: Thomas Strange, Goodview, MN (US)

(72) Inventor: Thomas Strange, Goodview, MN (US)

( * ) Notice: Subject to any disclaimer, the term of this patent is extended or adjusted under 35 U.S.C. 154(b) by 520 days.

(21) Appl. No.: 14/545,161

(22) Filed: Mar. 31, 2015

Related U.S. Application Data

(60) Provisional application No. 61/974,942, filed on Apr. 3, 2014.

(51) Int. Cl.

| | |
|---|---|
| ***A47G 33/04*** | (2006.01) |
| ***A47G 33/08*** | (2006.01) |
| ***A47G 33/06*** | (2006.01) |
| ***A47G 33/10*** | (2006.01) |

(52) U.S. Cl.
CPC ..... *A47G 33/08* (2013.01); *A47G 33/06* (2013.01); *A47G 33/10* (2013.01)

(58) Field of Classification Search
CPC ..... A47G 33/08; A47G 33/06; A47G 33/10; A47G 33/04; A47G 33/12; A47B 43/00; A47B 96/06
USPC ..... 428/8, 17, 18, 19, 20; 47/42; 211/187; 403/1, 24, 53, 64, 169, 190; D11/117, D11/118, 125, 130, 225, 241
See application file for complete search history.

(56) References Cited

U.S. PATENT DOCUMENTS 5,085,901 A * 2/1992 Johnson ..... A47G 33/06 211/196

* cited by examiner

*Primary Examiner* — David Sample
*Assistant Examiner* — Elizabeth Collister
(74) *Attorney, Agent, or Firm* — M Paul Hendrickson

(57) ABSTRACT

A C-shaped separating device equipped with vertical tree trunk couplers which serve to separate normally adjacent trunk sections of an artificial tree. A display panel and a foliaged branch mounting assembly mounted to the separating unit creates an aesthetically appealing artificial tree display.

19 Claims, 9 Drawing Sheets

ARTIFICIAL TREE DISPLAY DEVICE

CROSS-REFERENCE TO RELATED APPLICATION

This application is a non-provisional application of provisional application 61/974,942 filed Apr. 3, 2014, the contents of which are incorporated herein and made a part of this application in its entirety.

FIELD OF INVENTION

The present invention relates to tree spacing units and more particularly to a device which separates tree trunk sections to provide space for a display site and its use.

BACKGROUND OF THE INVENTION

It is desirable to display a seasonal or other appropriate display within the foliage of an artificial tree. Numerous attempts have been made to provide such an aesthetic tree display. Unfortunately past attempts have resulted in rather hideous displays which destroy the innate beauty of the tree. A desire for an artificial tree display especially arises during the Yule holidays. Nativity, Santa Claus, elves, reindeers, snowman, Snow White, Seven Dwarfs, etc. displays would be highly desirable if such a display preserved the aesthetic tree appeal.

Within the past several decades, artificial Christmas trees have become increasingly more popular. Artificial Christmas trees are commonly provided in trunk sections disassembled and reassembled via trunk end couplers or joinders which couple the tree trunk sections together. Typically each ascending tree trunk section matingly fits onto couplers at their terminating trunk sections ends. As the trunk sections ascend, the trunk diameter of the trunk sections typically decrease with a diminishing coupler size for each ascending trunk section. The trunk sections are usually provided with branch holders or receiving orifices which allow the desired tree or branch foliage to be assembled onto the assembled tree trunks. As the tree height ascends, the radii of the off-shooting tree branches also decreases to provide the desired Christmas tree shape. Some of the more modern artificial trees come in trunk sections which allows the foliage to collapse for stowing or extend to a branched foliage by hinges, levered or block and tackle etc. mechanisms. Many of the current artificial trees are fully equipped with Christmas lighting systems.

There exists no current device or means for providing an aesthetic display within an existing assembled artificial tree structure. Past attempts have failed to maintain the desired aesthetic appeal of a full and desirable Christmas tree foliaged appearance.

DETAILED DESCRIPTION OF INVENTION

Figure 1:
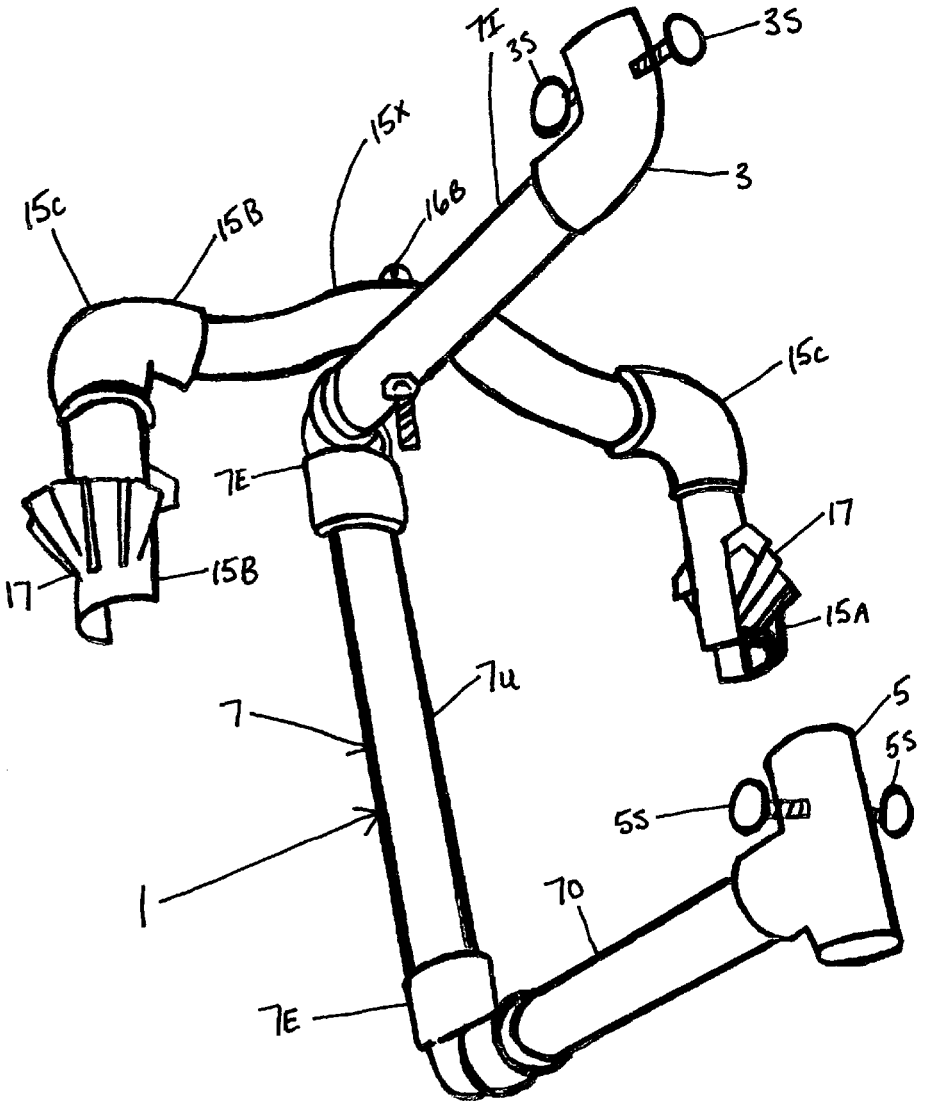
FIG. 1 is a side view of a tree spacing unit of this invention.
Figure 2:
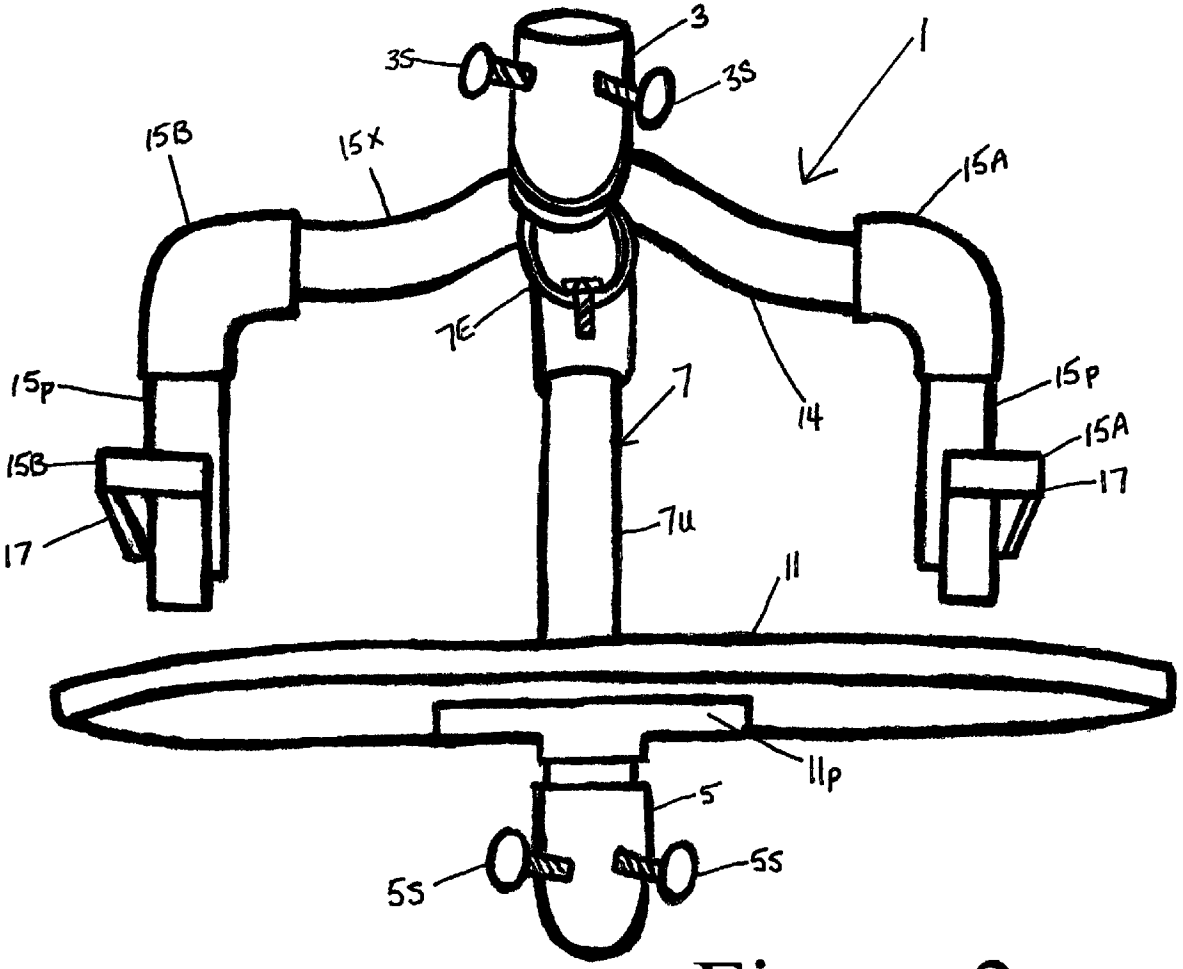
FIG. 2 is a frontal view of the unit shown in FIG. 1 equipped with a display platform.
Figure 3:
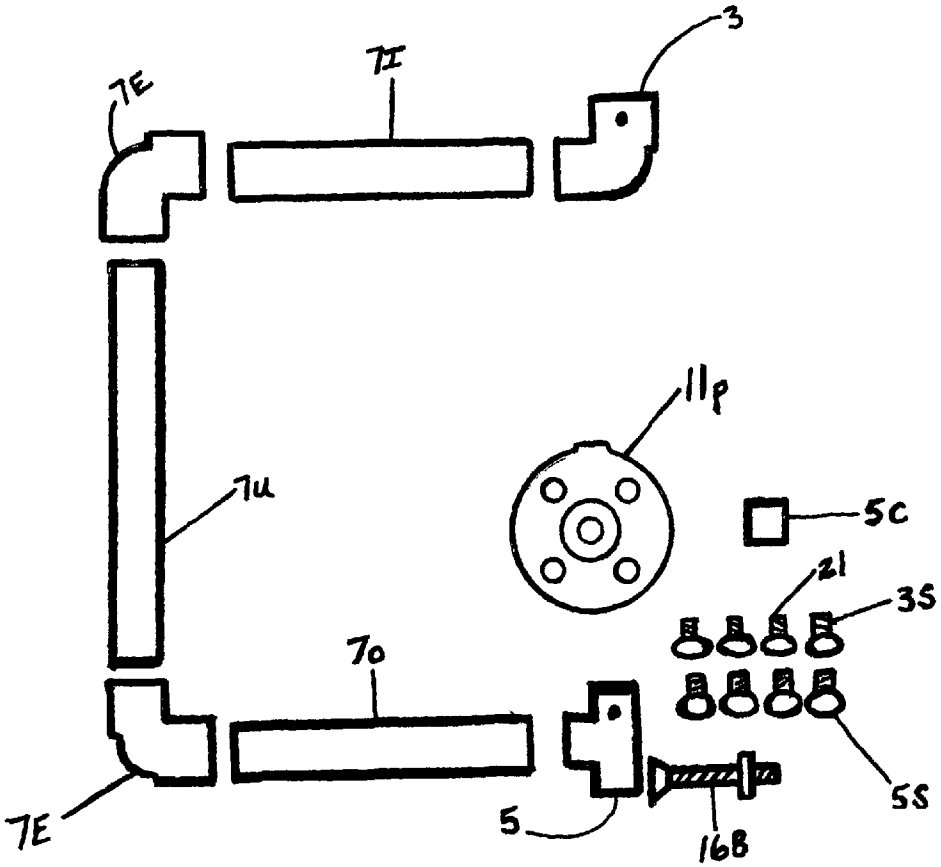
FIG. 3 depicts in part a disassembled view of the tree spacing unit shown in FIG. 1.
Figure 4:
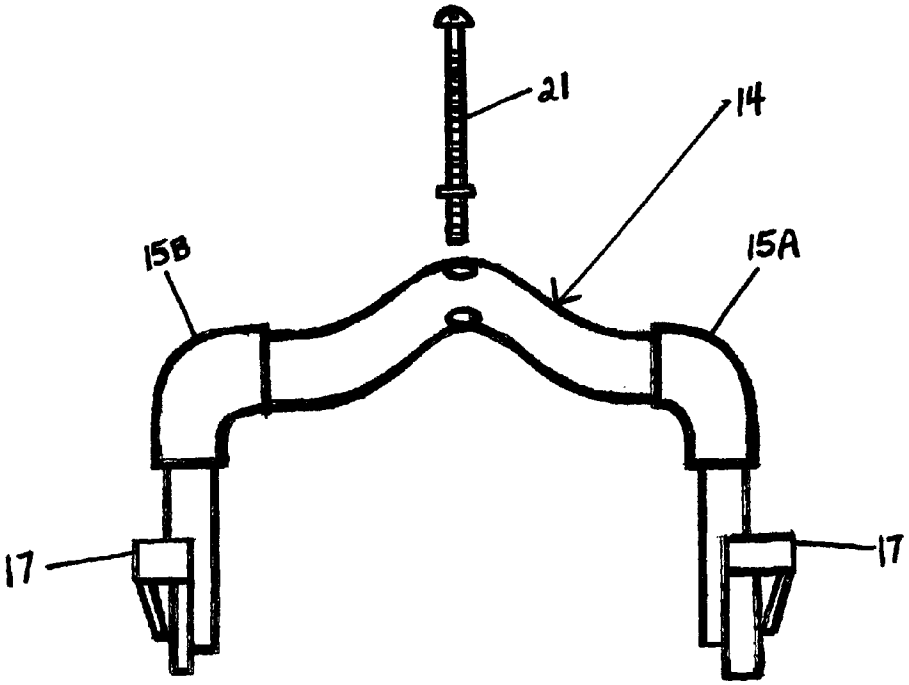
FIG. 4 depicts a disassembled view of the branch mounting assembly of the tree spacing unit shown in FIG. 1.
Figure 5:
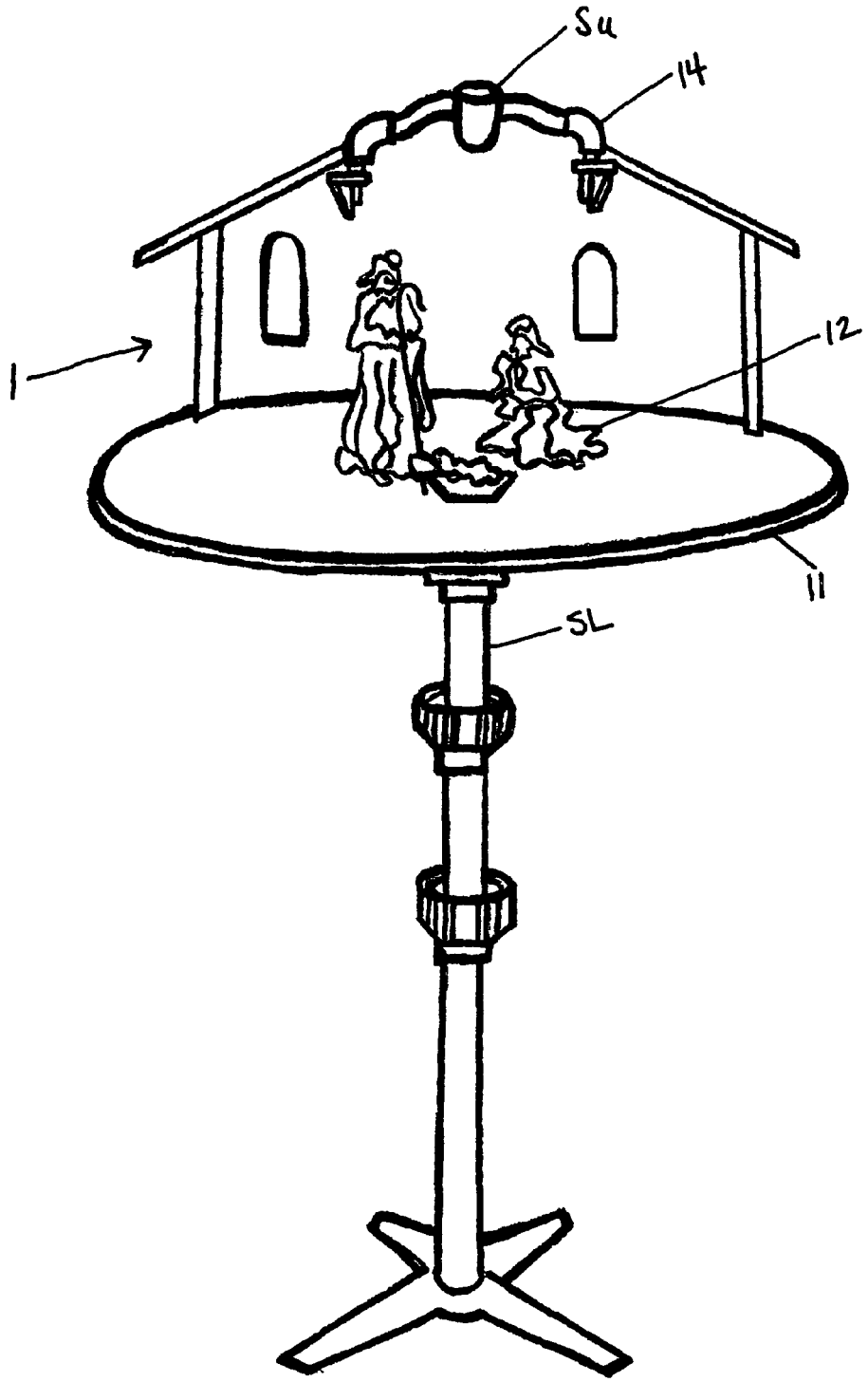
FIG. 5 depicts a frontal view of artificial tree sections assembled together with the tree spacing unit of FIG. 2 depicting a nativity display.
Figure 6:
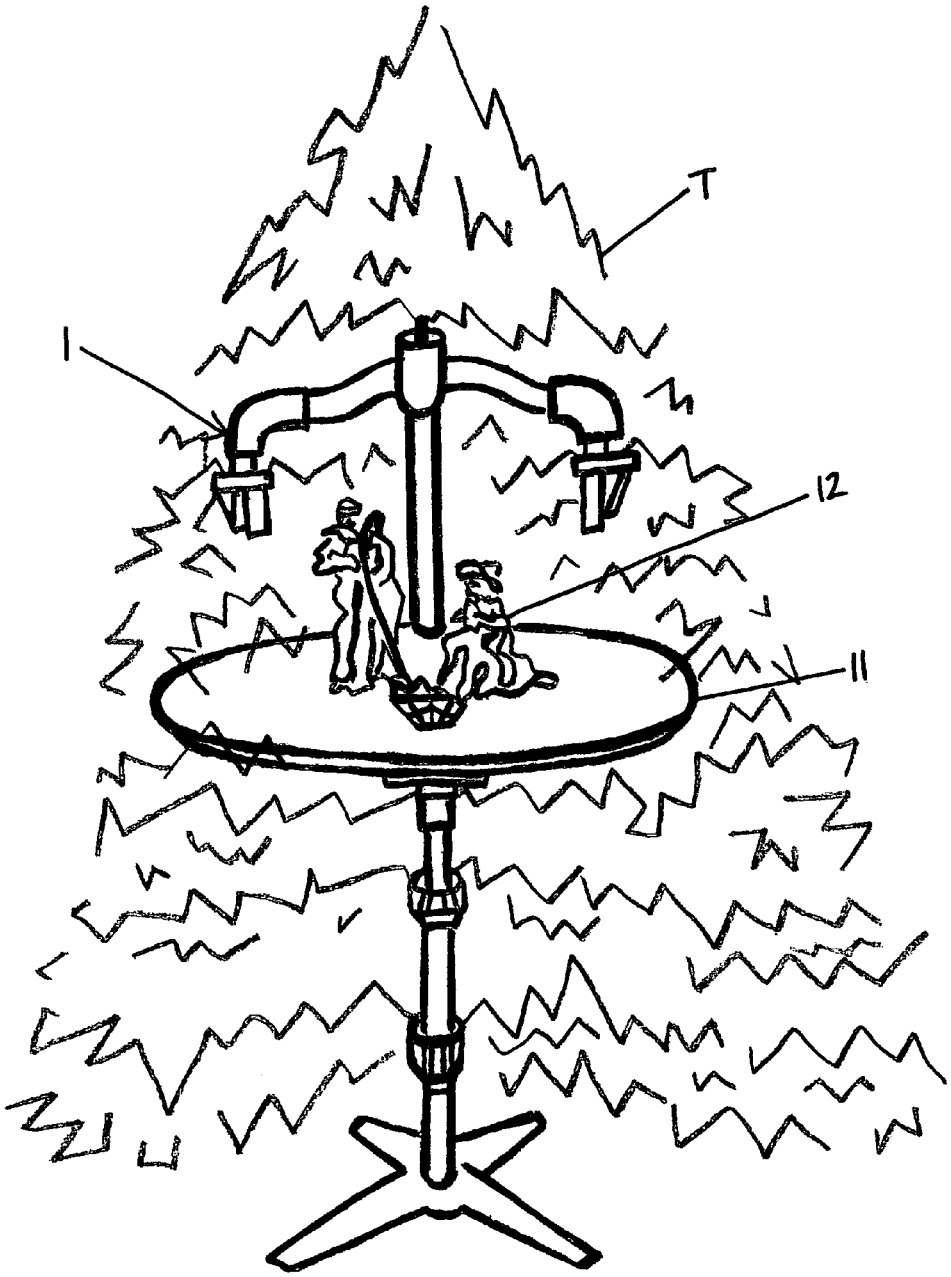
FIG. 6 depicts a partial view showing the foliated lower and upper trunk sections separated by the branch mounting assembly of FIG. 2.
Figure 7:
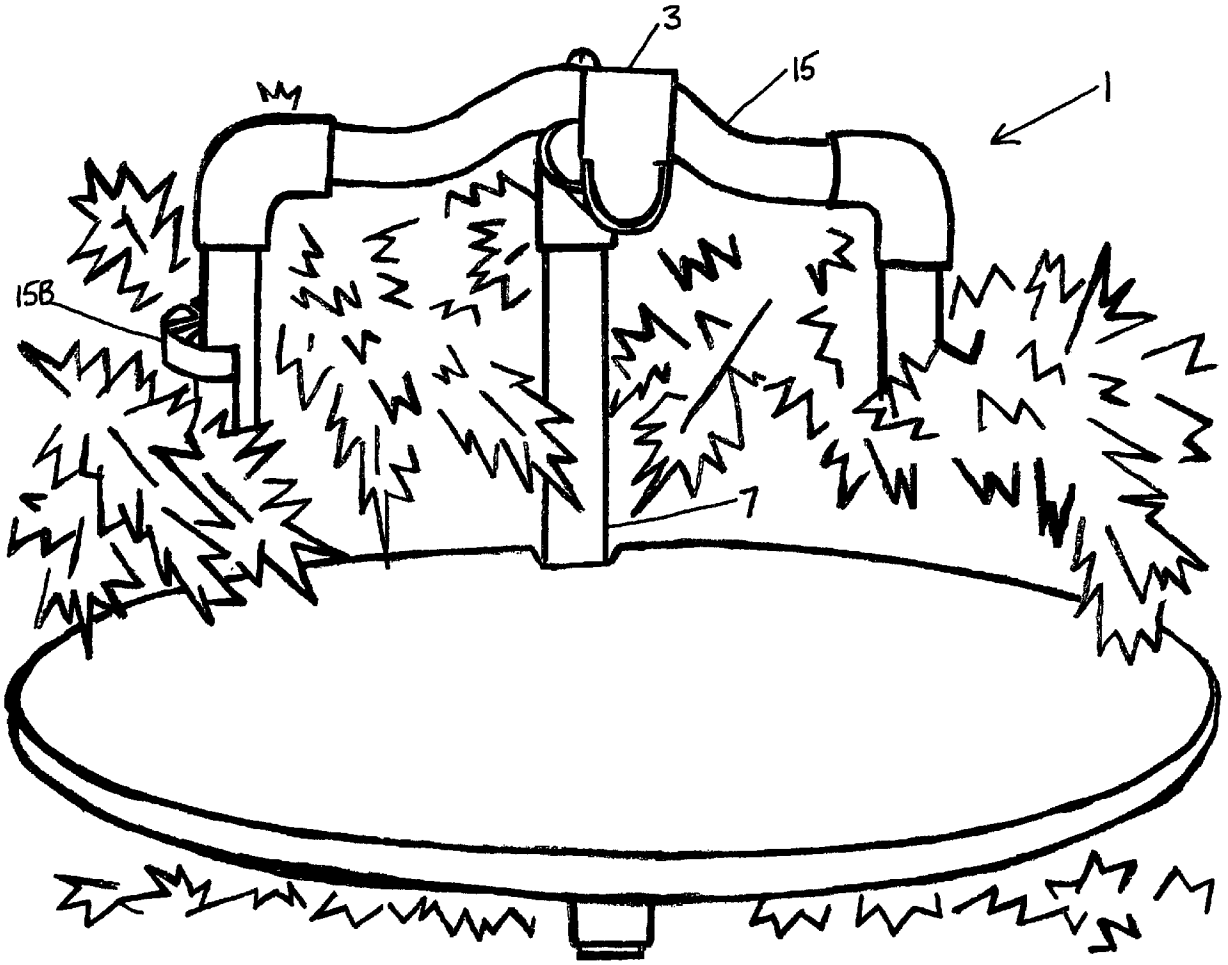
FIG. 7 is a partial frontal view of the foliated branch mounting assembly shown in FIG. 6.
Figure 8:
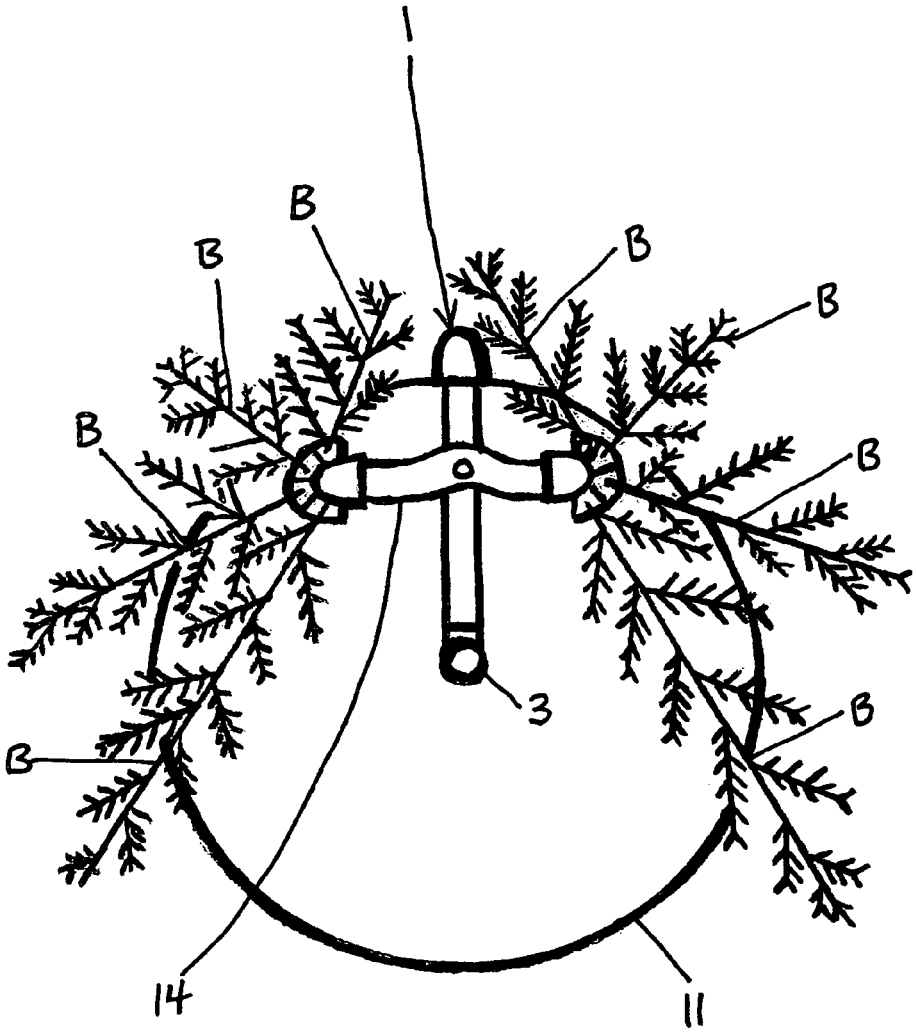
FIG. 8 shows a top view of the unit depicted in FIG. 2 foliated with the tree branches.

With reference to the Figures, the present invention provides an artificial tree trunk spacing device 1 for supporting a decorative display 12 in an artificial tree T equipped with an assembled trunk section S, said spacing device 1 comprising:

A. an upper tree trunk coupler 3 and a lower tree trunk coupler 5 equipped to respectively engage onto a more elevated artificial tree trunk section $S_U$ than a lower artificial tree trunk section $S_L$ to provide a desired display site between said more elevated tree trunk section and said lower tree trunk section, with said upper coupler 3 and said lower coupler 5 being in vertical alignment with one another and each being desirably equipped with a trunk section end stop $\mathbf{3}_S$ & $\mathbf{5}_S$ for respectively stopping and preventing the upper tree trunk section $S_U$ and the lower tree trunk section $S_L$ from sliding therethrough;

B. a supportive spacing unit 7 bridging between said upper coupler 3 and said lower coupler 5 with said spacing brace 7 providing a circuitous bridge of sufficient depth and height between said upper coupler 3 and said lower coupler 5 to provide sufficient spacing therebetween to permit the decorative display 12 to be displayed therewithin while also providing sufficient structural support to maintain the lower trunk section $S_L$ and the more elevated trunk sections $S_U$ of the assembled tree T in vertical alignment, C. a branch mounting assembly (generally prefixed by 15) equipped with a plurality branch mounts 17 for mounting a plurality of foliaged branches B having a desired adornment of foliage thereto so as to thereby provide a desired array of tree branch foliage about the display 12 mounted to said spacing device 1, and D. a mountable pedestal 11 mountable onto the device 1 at a desired display site for displaying the decorative display 12.

The present invention provides a decorative separating and spacing device 1 for coupling together two normally adjacent artificial tree trunk sections (generally prefixed by S) of an artificial tree T to provide a desirable display 12 site without substantially diminishing the aesthetic foliaged appeal of the artificial tree T. The spacing device 1 entails two oppositely positioned in-line tree trunk section couplers 3 & 5 adapted to fit and couple onto what would be two normally adjacently positioned two trunk sections ($S_U$ & $S_L$) for which the spacing device 1 is designed to separate. The two oppositely positioned couplers 3 & 5 are spaced apart by a vertically extending circuitous bridging section (general prefixed by 7) with the bridging section 7 placing couplers 3 & 5 in a vertical alignment with one another with the circuitous bridging section 7 affording sufficient spacing between couplers 3 & 5 for the desired display 12. The spacing device 1 may be used to separate and space apart any two normally adjacently positioned trunk sections 5 of an artificial tree T. The upper coupler 3 and the lower coupler 5 are adapted to seat and maintain an upper trunk section $S_U$ and the lower trunk section $S_L$ of the artificial tree T in a stable upright position.

A circuitous spacing unit 7 creates a hollowed spacing between adjacent trunk sections $S_L$ & $S_U$. This recessed positioning can be effectively accomplished by a circuitous outwardly and inwardly ascending features of the vertical or bridging unit 7. The vertical separating and bridging unit 7 equipped with laterally separated couplers 3 & 5 provides a circuitous bridge depicted as bridging sections $\mathbf{7}_O$, $\mathbf{7}_U$ & $\mathbf{7}_I$ sized to allow for adequate spacing to permit a desired display 12 to be displayed between the separated trunk sections $S_L$ & $S_U$. This may be suitably provided by outwardly extending bridge section $\mathbf{7}_O$, an upwardly projecting bridging section $\mathbf{7}_U$ and then onto an inwardly projecting bridge section $\mathbf{7}_I$ collectively of sufficient dimensional size to place the upper coupling unit 5 in vertical alignment with the lower coupling unit 3 while affording sufficient spacing for display 12. A significantly enhanced display viewing site is accordingly provided by the circuitous bridging section 7. The bridging and spacing unit 7 need not be of three angled sections as depicted, but may be of any form capable of providing a recessed bridging span for the display positioned between couplers 3 & 5. Thus, the desired bridging unit 7 may also be of any arcuate form.

The lower coupler 5 of circuitous section 7 may serve as a suitable mount 9 for mounting a displaying panel 11 to provide structural support for a desired display 12 displayed thereupon. By placing the displaying member 11 in a recessed viewing area within the artificial tree T (such as a centered viewpoint as provided lower coupler 5), the natural aesthetic appeal of the tree T may be effectively preserved and allow for partial concealment by a peripheral foliage mounting assembly (generally designated as 14) which leaves a centralized open tree space open for viewing.

Any suitable displaying member 11 or panel which supports a desired display 12 may be used to display any desired display as provided by the tree trunk section separating unit 1 of this invention. The size of the displaying member 11 (e.g. a supportive pedestal) may desirably vary depending upon tree size and the desired decorative display 12 to be displayed thereupon. Typically the displaying panel 11 supported by any display supportive member $\mathbf{11}_P$ such as pedestal $\mathbf{11}_P$ will provide a display area of at least six square inches and more typically a surface area of more than ten square inches. Thus, display areas ranging from about 80 to about 200 or more square inches may be provided without destroying the aesthetic tree appeal. Because the spacing and displaying device 1 coupled with its branch mounting assembly 14 affords a means for partially occluding or camouflaging its open structural character, displays covering a substantial portion of the tree diameter may be occupied by the display 12.

The utilization of trunk end stops $\mathbf{3}_S$ & $\mathbf{5}_S$ effectively serve to maintain the trunk sections $S_U$ & $S_L$ at an appropriate elevational position. Stops $\mathbf{3}_S$ & $\mathbf{5}_S$ may be integrated into the construction of the trunk spacing device 1 or alternatively integrated into the construction of trunk sections $S_U$ & $S_L$. Stops $\mathbf{3}_S$ & $\mathbf{5}_S$ serve to respectively wedge or stop the tree trunk sections $S_U$ & $S_L$ from vertical slippage when secured within the trunk section couplers 3 & 5. Trunk sections $S_U$ & $S_L$ may be fitted with stops $\mathbf{3}_S$ & $\mathbf{5}_S$ of any suitable stop type such as a projecting trunk stop (e.g. a pin, bolt, flange, rim, trunk section diameter decrease, etc.) which effectively stops the trunk section $S_U$ & $S_L$ from gravitational slippage. Most suitably, however, trunk stops $\mathbf{3}_S$ & $\mathbf{5}_S$ are integrated within the trunk section spacing device 1. This may be effectively accomplished such as by reducing the available tree trunk receiving diameter within couplers 3 & 5 (e.g. sleeves, coupler bends such as created by elbowed couplers, stopping plugs within the couplers 3 & 5, etc.). Particularly effective stopping members $\mathbf{3}_S$ & $\mathbf{5}_S$ are of the type which firmly wedge or biase the tree trunk sections $S_U$ & $S_L$ to couplers 3 & 5 such as illustratively depicted by FIGS. 1-3, 7 and 9.

The spacing device 1 includes a foliage branch mounting assembly 14 having at least one foliage branch mounting unit 15 equipped with multiple tree branch mounts 17 which serves as individual mounts for branched foliage application which partially camouflages the open tree areas created by the separating display unit 1. The branch mounting assembly 14 suitably provides a sufficient line of sight to permit a viewing of the desired display 12 while also preserving the aesthetic foliaged tree shape and appeal. The desired degree of camouflaging by the foliaged branch mounting assembly 14 may be accomplished by one or more branch foliage mounting units 15A & 15B positioned to provide the desired camouflaging effect to the open space created by the display space. With reference particularly to FIGS. 1-3, 4 and 6-8, the depicted branch mounting assembly 14 involves one or more branch mounting units (shown as 15A & 15B) strategically positioned to permit branch mounting of the camouflaging foliated branches B in a position to maintain the aesthetic tree appeal. Similar to the artificial trunk sections S, the branch foliage mounting units 15A & 15B are provided with a plurality of branch mounting sites 17. The branch mount sites 17 may be of any suitable mounting site 17 serving to mount the foliaged branches B to the branch mounting unit 15 or units (e.g. 15A & 15B). The most common branch mounts 17 for artificial Christmas trees is in the form of branch receiving mounts 17 which also applies to the foliage branch mounts 17 herein. Although the branch mounting assembly 14 may be positioned at any suitable camouflaging position about the display 12, positioning and mounting the branch mounting units 15A & 15B perpendicularly to the longitudinal tree axis at an offset position about upper coupler 3 with arcuate branch mounts 17 therewithin provides a particularly effective branch mounts 17 for mounting the foliaged branch mounting units 15 to the spacing device 1. If desired, the branch mounting unit 15 accordingly may bridge between or about couplers 3 & 5 to provide the branch mounting sites 17 with arcuate mounts 17 for foliaged branches B sized to mate the tree circumference at their mounting site 17. The branch mounting unit 15 may be of any suitable form (e.g. L, T, Y) arched or any other suitable branch mounting configuration adapted to position the camouflaging branches B at the desired camouflaging outwardly position. In order to provide an aesthetic appeal a plurality of foliaged branches B will be typically required to be mounted to one or more branch mounting units 15. If desired, the branch and foliage unit 15 may consist of a single piece unit or multiple units fully equipped to mount the desired foliaged branches B. The branch holding assembly 15 may be secured to the circuitous supportive brace 7 by any securing means such as by bolting with bolt $\mathbf{16}_B$, gluing, pivotal mounts, etc. Alternatively, the foliated branches B may be pivotally mounted to the branch mounting unit 15 which mount 17 pivots the branched foliage B to its extended branched position and retracts for stowing.

The camouflaging branch mounting unit or assembly 14 may be provided in a variety of different shapes (e.g. linear, curvilinear, etc.). A particular effective mounting site for the branch mounting unit 15 will be typically positioned near or about an off-set positioning of the longitudinal axis of the assembled tree sections $S_L$ & $S_U$. The camouflaging branches B are most appropriately provided in a plurality of different lengths adapted to conceal but yet maintain the desired tree symmetry of the artificial tree. These features retain the openness as provided by the spacing device 1 while retaining the tree T symmetry and its innate beauty. Although the number of camouflaging branches B will depend upon tree size and extent of openness created by the spacing device 1, normally at least four branches B mounted to the foliage assembly 14 will create a desired effect. Although about 4 up to 20 branches or more may be mounted to the branch mounting assembly 15, most typically from about 4 to less than 10 camouflaging branches B mounted to the branch mounting assembly 15 will accomplish the desired camouflaging effect. The desired branch lengths will depend primarily upon their positioning upon the branch mounting assembly 15 and the length needed to provide the desired tree T symmetry. The branches B and foliage will desirable match that of the artificial trees T. Accordingly the foliaged branches B will typically be of diverse lengths to create and maintain the desired tree symmetry.

The depicted branch mounting assembly 14 may comprise a modified conventional bisected artificial tree branch holders used extensively for manually mounted branch systems. Such conventional branch holders are typically of a doughnut shape which are positionally secured to the trunk sections at an appropriate branch mounting site. As may be observed from FIGS. 1-3, 7 and 9, the depicted individual branch mounts comprise a plurality of radial positioned slotted mounts sized to slot onto the foliated branch B which creates an L-shaped channel terminated by an aperture adapted to receive the terminal L-shaped mounting ends of branch B. These conventional Christmas tree branch holders typically include about eight circumscribing slotted branch mounts for mounting the foliated branches thereto. By cutting these conventional branch holders into bisected halfs and positioning the two semi-circular branch mounting units 15 in an outwardly facing and off-set position as depicted in particular by FIGS. 1-2, 4 and 6-9, a highly desirable aesthetic off-set peripheral branch mounting assembly 14 about a display 12 is achieved. Since the off-set mounts 17 of the foliated branches B necessitates shorter branch lengths to maintain tree symmetry, the branch lengths may be accordingly properly sized to match their tree mounting position. Each of the branch mounting units 15 allows for multiple branch mounts 17 at differing radial mounting sites to be effectively utilized to create the desired aesthetic placement of branches B. Normally multiple branches B (e.g. about 2 to 5) are mounted to each branch mouthing unit and most typically two to three branches B are mounted to each branch unit 15. If desired, the branch assembly 14 may include collapsible or a hinged branch system.

Referring in particular to the depicted foliage supportive branch assembly 14, the depicted assembly 14 includes an in-line yoked pipe section $\mathbf{15}_X$ equipped to receive threaded and nutted bolt $\mathbf{16}_B$ which bolts onto inward bridging section $\mathbf{7}_I$. The yoked pipe section $\mathbf{15}_X$ is depicted as being cornered at opposite ends with a 90 degree cornering elbows $\mathbf{15}_C$, a short downwardly extending section 15E coupled to the cornering elbows $\mathbf{15}_C$ onto which the foliated branch mounts 17 are positioned about an outwardly mounting projecting arc. The branch mounts 17 may be suitable branch mounting means and may simply constitute drilled apertures about the arcuate surface of branch holder unit or assembly 15.

By displaying the branch holders 15 at an off-set position from upper coupler 3, the foliage assembly 14 affords an optimal view of the display 12 while also providing the appearance of a fully foliaged tree. The off-setting position of the off-setting branch mounts 17 will typically be dictated by tree size. Off-setting the mounts 17 by more than about two inches to less than about ten inches typically provides a particularly attractive camouflaged display 12 for most trees T. The foliaged branches B mounted to foliaged mounting holders 15 are sized and at a number sufficient to match the symmetry of the artificial tree T. Providing the branch mounting unit 15 in an arcuate form and particularly as two curved branch mounting units 15 affords an easier manner in achieving the desired effect.

The spacing device 1 should create a space within the artificial tree trunk section $S_L$ & $S_U$ to create a viewable display. The vertical distance between the upper tree trunk section coupler 3 and the lower tree trunk section coupler 5 generally governs the viewable space. Typically the display panel will be supported as depicted by the FIGS. 2 and 5-8 in juxtaposition of the lower tree trunk section coupler 5 whereas the branch mounting assembly mounting sites 15 are at an off-set positional relationship to the upper tree trunk section coupler 3. The off-setting of the branch assembly mounts allows for viewing while maintaining the desired aesthetically pleasing foliated appearance. Typically the upper and lower couplers 3 & 5 will be placed at about a half foot to less than about two feet apart for most standard Christmas tree types (e.g. less than 20 feet in length) with larger trees permitting larger spacing and miniature trees substantially less in spacing. For most artificial applications, the spacing between the lateral upper and lower couplers 3 & 5 will range from about one foot to less than about one and a half foot. The branch mounting sites 17 are positioned at an off-set position to create a peripheral margining of foliage which creates a centralized viewing space. The paired branch mounting units 15A & 15B will typically be placed for standard household tress at a lateral distance of more than about four inches and typically more than six inches and most typically within the range of about one half foot to less than about one foot.

As artificial Christmas trees have gained in popularity, the desire for more ornate and readily assemble artificial trees has resulted in changes as to how the trunks sections S are assembled together and opened to a fully foliated tree sections S. These changes have resulted in artificial Christmas trees which incorporate lighting systems and hinged foliaged branches into their design. The spacing unit 1 of this invention may be adapted for use in combination with these more modern fully equipped artificial trees T. Such newer artificial tree versions are also commonly provided in three trunk sections S which is also most common to the older artificial trees. The newer type of trees typically have trunk sections S with branch sections hingablely mounted so that upon assemble one merely pulls upon a pulleyed string or hinged branches B to extend the hinged branches onto their desired fully foliated tree sections as partially portrayed in FIG. 9. Closure may be accomplished by a reverse procedure to allow the branches B to collapse along the longitudinal axis of the trunk section S. The electrical wiring system L for lighting the lights including LED lights generally powered by an in-line power source feed through the trunk sections. If desired, a supplemental electrical lighting circuitry L (depicted by the phantom lines of FIG. 9) or any other suitable electrical linkage may be used to link the separated trunk sections $S_U$ & $S_L$ together.

In the case of the older and more conventional trees T, the sleeves normally provided about the upper $S_U$ end of the lower $S_L$ tree sections afford an excellent adapter for fitting the separated trunk sections into the spacing tree trunk coupling members 3 & 5 herein. If necessary a wrapper, cylindrical sleeve or other sizing adapter about the tree trunk sections S may provide a desired circumferential fit for joining trunk sections $S_U$ & $S_L$ ends together in a stabilized upright position. Similarly, the upper and lower tree trunk coupling units 3 & 5 may be sized or equipped with sleeved adapters to mate onto the connecting tree trunk sections S. A further alternative as depicted by the Figures comprises providing either the upper and/or lower tree couplers 3 & 5 with threaded apertures for set screws $\mathbf{3}_S$. Threaded set screws $\mathbf{3}_S$ & $\mathbf{5}_S$ (also serving as stops $\mathbf{3}_S$ & $\mathbf{5}_S$) maybe easily threaded into the PVC couplers 3 & 5 simply by drilling a slightly undersized bore and then by threading self-threading the set screws $\mathbf{3}_S$ thereto. Threaded stops $\mathbf{3}_S$ & $\mathbf{5}_S$ serves a dual purpose of stabilizing the upright positioning of trunk sections $S_U$ & $S_L$ and anchoring the trunks sections $S_U$ & $S_L$ from vertical slippage.

Figure 9:
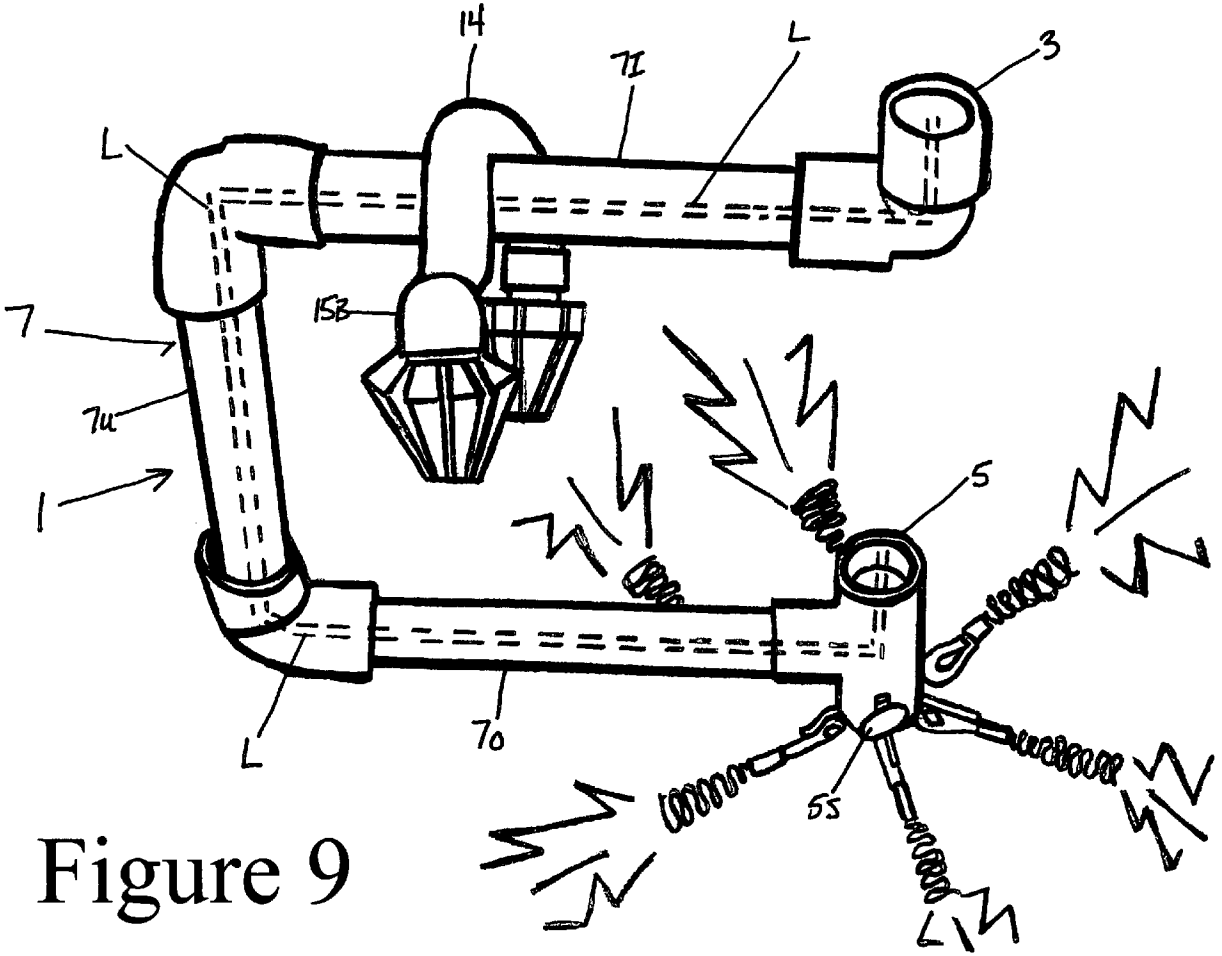
FIG. 9 is a top view of an artificial tree lower trunk section equipped with hinged branches and a lighting system showing the tree separating unit of FIG. 1 fitted with internally disposed electrical conduit system depicted by the phantom lines therein.

With respect to tree sections $S_U$ & $S_L$ equipped with lights and hinged foliage, these trees T are normally provided with a centered projecting shaft extending downward from the upper tree trunk section $S_U$ while the connecting lower tree section $S_L$ is typically equipped with a mating shaft receiving bore which mates onto the trunk shaft of the upper tree trunk section $S_U$. For such artificial trees, the lower trunk section $S_L$ which contains a flat trunk top section may be adapted to fit the lower coupling unit 5 in the same fashion as mentioned hereinbefore mentioned with respect to the older and more conventional tree trunk sections S. The shaft connector of the upper tree trunk section $S_U$ may be accommodated within the upper coupler 3 by drilling a hole sized to accept the projecting trunk section shaft with a tight clearance therebetween. Either adapters or set screws $\mathbf{3}_S$, if necessary, may also be used to firmly secure the upper coupling unit 3 to the upper trunk section $S_U$. If the trunk sections $S_U$ & $S_L$ are internally designed to conduct electrical currents within the tree trunk sections S, a conductive attachment L to conduct the electrical currents may be adapted thereto. Illustratively of such an electronic circuitry provided by an internal electrical line L within the hollow of the spacing device housing (shown as phantom lines in FIG. 8) or external wiring connecting the artificial tree electrical systems L together. Although artificial tree equipped with lighting systems may be powered by separate chords for each lighted section, it is advantageous to incorporate the electric circuitry L which allows the entire tree to be served by a single wired circuit. FIG. 9 illustrates an internally disposed wired circuitry L servicing the electrical terminal ends of the tree trunk lighting circuitry depicts the necessary circuitry for interconnecting the respective circuitry together.

Example

The tree separating unit 1 depicted by the Figures herein may be fabricated with commonly available retail supplies (e.g. ¾ inch PVC pipe fittings) appropriately machined and secured together with PVC glue. With reference to the designations of the Figures at the designated quantities and sizes (in parenthesis), the tree spacing unit 1 may be fabricated from the following components.

PVC Socket Flange $\mathbf{11}_P$ (1)
PVC Elbows 3 &7E (3)
PVC Tee 5 (1)
PVC Vertical pipe $\mathbf{7}_U$—9½ inches (1)
PVC Horizontal pipe $\mathbf{7}_I$ & $\mathbf{7}_O$ —7½ inches (2)
Thumb Screws $\mathbf{3}_S$ & $\mathbf{5}_S$—¼ inch 20×½ (8)
Machine Stop Screws $\mathbf{3}_S$ & $\mathbf{5}_S$—Size 10-24×2½ (2)
PVC Pipe 1 inch long $\mathbf{5}_C$ (1)
Condensate Trap $\mathbf{15}_X$ (1)

The branch holders 15A & 15B may be fabricated with ¾ inch pipe fittings from the following components.

PVC Elbows $\mathbf{15}_C$ (2)
Condensate Trap $\mathbf{15}_X$ (1)
Branch holders 15A & 15B (2)
Bolt and nut $\mathbf{16}_B$ 2×¼ inches (1)
PVC pipe $\mathbf{15}_P$ (2)
Trunk spacing device 1
Upper coupler 3
Lower coupler 5
Trunk end stops/Threaded set screws $\mathbf{3}_S$ & $\mathbf{5}_S$
Supportive brace 7
Outward bridge $\mathbf{7}_O$
Inward bridge $\mathbf{7}_I$
Upward bridge $\mathbf{7}_U$
Display panel 11
Panel mounting pedestal $\mathbf{11}_P$
Display 12
Branch mounting assembly 14
Branch mounting unit(s) 15 (15A & 15B)
Extending sections 15E
Cornering elbows $\mathbf{15}_C$
Yoked pipe section $\mathbf{15}_X$
Threaded nutted bolt $\mathbf{16}_B$
Branch mounts 17
Tree branches B
Electrical wiring system L
Truck sections S
Upper tree trunk section $S_U$
Lower tree trunk section $S_L$

What is claimed is:

1. An artificial tree trunk spacing adapter supportive of a decorative display positionable between a pair of separated artificial trunk sections of an assembled tree, said tree trunk spacing adapter comprising:

A. an upper tree trunk coupler and a lower tree trunk coupler of a sufficient size to respectively engage securely onto an upper tree trunk section and a lower tree trunk section, B. a supportive circuitous brace bridging and connecting onto said upper coupler and said lower coupler at a sufficient spacing so as to permit a decorative display to be displayed therewithin while also providing sufficient structural support to maintain a vertical alignment of the lower trunk section and the upper trunk section, C. a tree branch mounting assembly mountable to the trunk spacing adapter and equipped with a plurality tree branch mounts and a plurality of tree foliaged branches mountable to the tree branch mounts so as provide an array of foliaged tree branches about the decorative display, and D. a mountable pedestal for displaying the decorative display mountable onto the adapter at a desired display site.

2. The device according to claim 1 wherein the tree branch mounting assembly provides off-set branch mounting sites relative to a longitudinal axis as provided by a longitudinal alignment of the upper tree trunk section coupler to the lower tree trunk section coupler.

3. The device according to claim 2 wherein the branch mounting assembly comprises two branch mounting units laterally positioned on opposite sides of the longitudinal axis.

4. The device according to claim 3 wherein the lateral distance between the upper tree trunk section coupler and the lower tree trunk section coupler is sufficient to permit a mounting of a viewable decorative display.

5. The device according to claim 2 wherein the upper coupler and the lower coupler when coupled to the circuitous brace are laterally positioned at least 9 inches apart.

6. The device according to claim 5 wherein the branch mounting assembly comprises two branch mounting units having multiple branch mounting sites oppositely positioned at an off-set position from an imaginary longitudinal axis extending between the upper tree trunk coupler and the lower tree trunk coupler when coupled to the circuitous brace with the units being laterally positioned at least four inches apart.

7. The device according to claim 4 wherein each coupler is equipped with a trunk end stop for stopping and preventing the upper tree trunk section and the lower tree trunk section from sliding therewithin.

8. A method for providing an artificial tree having a number of assembled trunk sections equipped with foliaged branches and a decorative display therewithin, said method comprising:

A) providing a tree trunk spacing adapter, comprised of:
   a) an upper tree trunk coupler and a lower tree trunk coupler of a sufficient size to respectively engage securely onto an upper tree trunk section and a lower tree trunk section at a desired display site,
   b) a supportive circuitous brace bridging and connecting onto said upper coupler and said lower coupler with said brace providing sufficient spacing to permit the decorative display to be displayed therewithin while also providing sufficient structural support to maintain a vertical alignment of the upper tree trunk section and the lower tree trunk section,
   c) a foliaged tree branch mounting assembly equipped with a plurality of the foliaged tree branches and a plurality of branch mounts for mounting the foliaged tree branches thereto and thereby provide a desired symmetrically array of the foliaged tree branches about the display, and
   d) a mountable pedestal mountable onto the spacing adapter at a desired display site for displaying the decorative display, and B) coupling the lower trunk section and the upper trunk section together with said tree trunk spacing adapter positioned therebetween to provide an artificial tree having the decorative display site therebetween.

9. The method according to claim 8 wherein the method includes a mounting of the foliated branches of a desired size and configuration to the tree branch mounting assembly.

10. The method according to claim 8 wherein the tree branch mounting assembly provides branch mounting sites at an off-set relationship from an extended longitudinal axis as provided by the upper tree trunk section and the lower tree trunk section.

11. The method according to claim 10 wherein the branch mounting assembly comprises two branch mounting units laterally positioned on opposite sides of the longitudinal axis and the method includes mounting the foliated branches to the mounting units to provide a desired branch coverage about the display site.

12. The method according to claim 8 wherein the lateral distance between the upper tree trunk section coupler and the lower tree trunk section coupler is sufficient to permit a mounting of viewable display therebetween and the method includes placing the decorative display upon a display panel supported by said pedestal.

13. The method according to claim 12 wherein the supportive circuitous brace bridging between upper coupler and the lower coupler provides at least a 9 inch separation between the upper tree section and the lower tree section.

14. The method according to claim 13 wherein the branch mounting assembly comprises two branch mounting units having multiple branch mounting sites oppositely positioned at an off-set relationship to a longitudinal axis extending between the upper tree trunk coupler and the lower tree trunk coupler and the method includes mounting a desired number of the branches to the foliated branch mounting sites.

15. The method according to claim 8 wherein each coupler is equipped with a trunk end stop for respectively stopping and preventing the upper tree trunk section and the lower tree trunk section from sliding therewithin.

16. An artificial tree combination equipped with a viewable display, said combination comprising:

A. A tree trunk spacing adapter comprised of:
   a) an upper tree trunk coupler and a lower tree trunk coupler of a sufficient size to respectively engage securely onto an upper tree trunk section and a lower tree trunk section,
   b) a circuitous supportive brace bridging and connecting onto said upper coupler and said lower coupler with said circuitous brace providing sufficient spacing to permit the viewable display to be displayed therewithin while also providing sufficient structural support to maintain a vertical alignment of the upper trunk section and the lower trunk section,
   c) a tree branch mounting assembly mounted to the trunk spacing adapter and equipped with a plurality branch mounts for mounting a plurality of foliaged tree branches thereto so as to provide a desired symmetrically array of tree branches about the display, and
   d) a mountable pedestal for displaying the decorative display mountable onto the spacing adapter at a desired display site; and B. an artificial tree having the upper tree trunk section and the lower tree trunk section secured and connected together by said spacing adapter.

17. The combination according to claim 16 wherein the tree branch mounting assembly includes branch mounting sites at an off-set relationship to a longitudinal axis as provided by the upper tree trunk section and the lower tree trunk section.

18. The combination according to claim 17 wherein the tree branch mounting assembly comprises two branch mounting units laterally positioned on opposite sides of the longitudinal axis.

19. The combination according to claim 18 wherein each coupler is equipped with a trunk end stop for respectively stopping and preventing the upper tree trunk section and the lower tree trunk section from slippage therewithin.

* * * * *